US007172364B1

(12) United States Patent
Nicholson

(10) Patent No.: US 7,172,364 B1
(45) Date of Patent: Feb. 6, 2007

(54) DROPPED CURB FINISHER

(75) Inventor: Leo Nicholson, Stratford (CA)

(73) Assignee: Nicholson Concrete, Stratford (CA)

( * ) Notice: Subject to any disclaimer, the term of this patent is extended or adjusted under 35 U.S.C. 154(b) by 0 days.

(21) Appl. No.: 11/378,535

(22) Filed: Mar. 17, 2006

(51) Int. Cl.
*E01C 19/42* (2006.01)

(52) U.S. Cl. ..... 404/96; 404/105

(58) Field of Classification Search ..... 404/96, 404/105

See application file for complete search history.

(56) References Cited

U.S. PATENT DOCUMENTS 3,363,524 A * 1/1968 Catenacci ..... 425/64
4,391,549 A * 7/1983 Murray ..... 404/87
4,397,626 A * 8/1983 Morrison ..... 425/64
4,789,266 A * 12/1988 Clarke et al. ..... 404/96
5,173,005 A * 12/1992 Henderson et al. ..... 404/98
5,527,129 A * 6/1996 McKinnon ..... 404/98
5,924,818 A * 7/1999 Holmes ..... 404/96
6,709,195 B2 * 3/2004 Piccoli et al. ..... 404/98

* cited by examiner

*Primary Examiner*—Gary S. Hartmann
(74) *Attorney, Agent, or Firm*—Fasth Law Offices Rolf Fasth

(57) ABSTRACT

The dropped curb finisher is for use with a slip form paving machines for forming continuous curbs and gutters. The dropped curb finisher has a vertical mounting plate, a finishing plate, an end plate and a vibrator for imparting vibration to the end plate and the finishing plate. The finishing plate extends rearwardly from the bottom edge of the mounting plate and the end plate inclines upwardly from the end of the finishing plate remote from the mounting plate. In another embodiment the present invention comprises a method of forming a dropped curb with a slip form paving machine for forming continuous curbs and gutters.

9 Claims, 5 Drawing Sheets

SECTION 'A'

DROPPED CURB FINISHER

FIELD OF THE INVENTION

This invention relates to a dropped curb finisher for use with a curb mold to slip-form concrete curbs and gutters.

BACKGROUND INFORMATION OF THE INVENTION

Self-propelled slip form paving machines for forming continuous curbs and gutters, sidewalks, safety barriers or the like by causing concrete or other suitable flowable material to be molded by a slip form mounted on the machine are well known. These paving machines typically comprise a frame, a drive engine, a hopper for concrete or other suitably flowable paving material and a mold in the desired configuration of the pavement to be formed i.e. sidewalk, curb, gutter, safety barriers etc. Typical machines are manufactured by Gomaco Corporation Inc., Power Curbers Inc. and others. See for example U.S. Pat. No. 5,662,431; U.S. Pat. No. 6,508,606. Manually operable concrete curb and gutter apparatus are also known. For example, see U.S. Pat. No. 4,566,823 and U.S. Pat. No. 5,527,129.

While these known devices adequately form a curb of standard height, problems are encountered when the height of the curb needs to be lowered to accommodate driveway entrances or ramps. If no provision is made for forming a section of the curb with a lowered height (dropped curb), the curb would need to be cut with a concrete saw after the concrete is cured. This is time consuming and does not provide a finished appearance to the concrete surface.

To overcome this problem several different solutions have been proposed. The most common approach is the use of a vertical plate that can be placed in the slip form in order to reduce the height of the curb by reducing the height of the concrete being extruded through the form. When the vertical plate (knife) is lowered to form a dropped curb for a driveway entrance the concrete is ripped off leaving a rough surface. In order to finish the surface, it is necessary to have up to four men following the slip form concrete mold and gutter device to form up and hand trowel the dropped concrete surface to remove excess concrete and finish the surface. This is time consuming and physically demanding work as the laborers are bent over continuously. This slows down the number of linear feet of curb that can be formed in a day and adds to the expense of the project. Examples of these types of devices are illustrated in U.S. Pat. No. 3,797,958 and Canadian Patent No. 2,043,773 and are found on machines such as the GT-6300 Curb & Gutter paver from Gomaco.

Other proposed solutions involve replacement of the mold, as shown for example in U.S. Pat. No. 5,662,431. U.S. Pat. No. 6,709,195 utilizes a moveable tailpiece that is rotated into position at the end of the mold to form a low curb section. None of these proposed solutions have proven to be effective and simple to operate.

There is a need for a device that will finish the surface of the dropped curb concrete, reduce the manpower required and improve the number of lineal feet that can be formed in a day where a number of driveway entrances or ramps need to be formed.

SUMMARY OF THE INVENTION

It is an object of the invention to provide a dropped curb finisher for use with slip form concrete curb and gutter apparatus.

Thus in accordance with the present invention there is provided a dropped curb finisher for use with a slip form paving machine for forming continuous curbs and gutters. The dropped curb finisher has a vertical mounting plate, a finishing plate, an end plate and means for imparting vibration to the end plate and the finishing plate. The finishing plate extends rearwardly from the bottom edge of the mounting plate and the end plate inclines upwardly from the end of the finishing plate remote from the mounting plate.

In another embodiment, the present invention comprises a method of forming a dropped curb with a slip form paving machine for forming continuous curbs and gutters. The slip form paving machine has a slip-form concrete curb and gutter mold consisting of an external housing having a cross section corresponding to the size and shape of the curb and gutter being formed. A dropped curb finisher according to the present invention may be inserted into the opening in the open end of mold when a dropped curb is to be formed. The method comprises the following steps:

(a) the slip form paving machine is stopped at about a point where the dropped curb is to begin,
(b) then means to stop the flow of concrete to the curb forming section of mold is activated,
(c) the paving machine is moved ahead slightly to clear the mold of concrete,
(d) a dropped curb finisher is inserted into the mold through an opening in the open end of the mold.
(e) as the slip form paving machine then moves forward, the flow of concrete is recommenced and means to impart vibration to the dropped curb finisher is activated, and
(f) when the desired length of dropped curb has been formed, the paving machine is stopped and the dropped curb finisher of the present invention removed from the mold.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
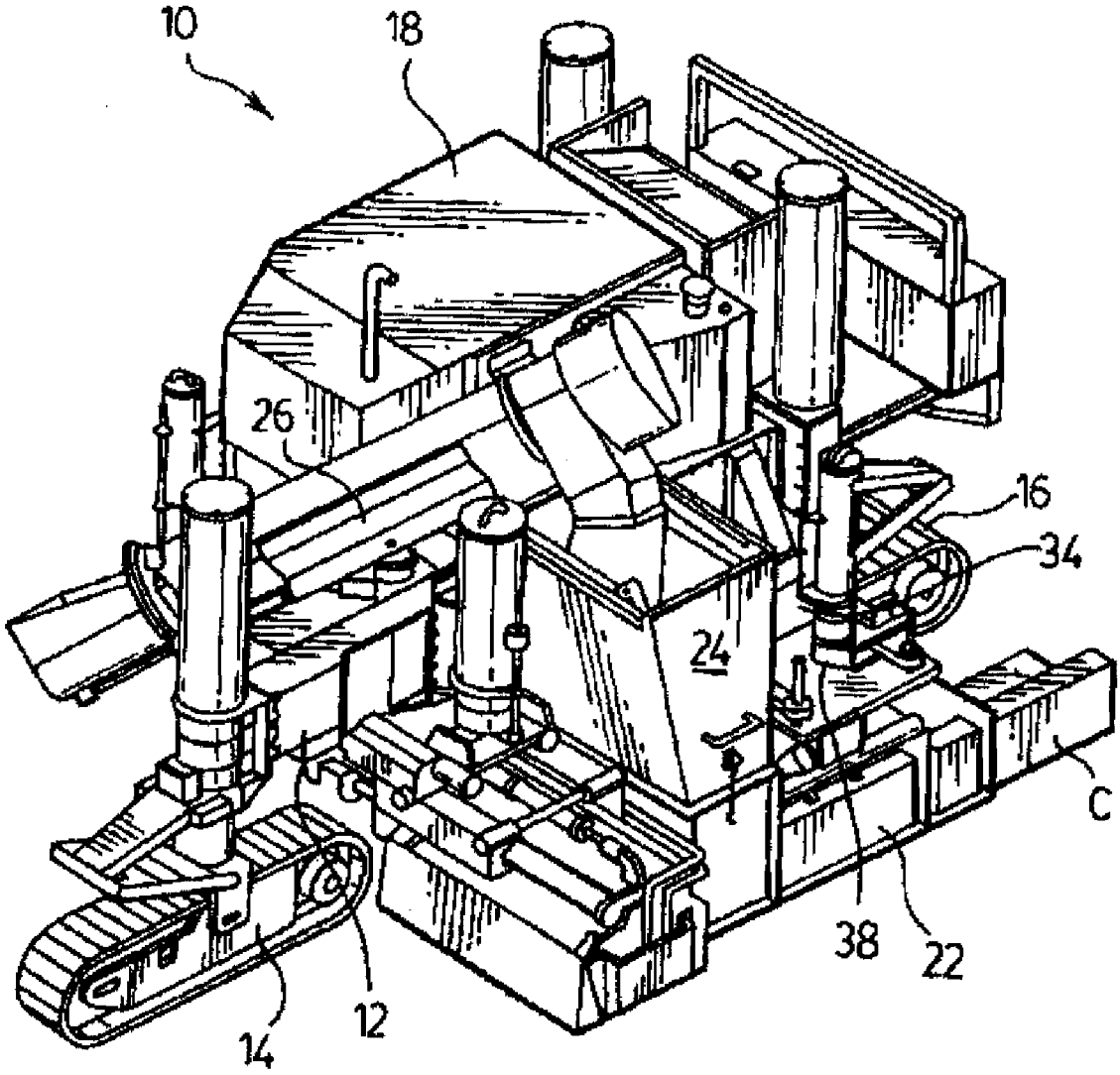
FIG. 1. (PRIOR ART)
FIG. 1 is a typical known self-propelled slip form paving machines for forming continuous curbs and gutters.

Referring to FIG. 1, a known prior art self propelled slip-form paving machine, as illustrated in U.S. Pat. No.

5,662,431, is generally indicated at 10. The paving machine 10 basically consists of a frame 12 supported on front and rear drive tracks 14, 16, and an engine 18 or other suitable power generator. A mold 22 is supported from the frame and having the configuration of the pavement to be formed i.e. sidewalk, curb, gutter, safety barriers etc. In FIG. 1, mold 22 is shown with a form suitable to form a curb and gutter generally indicated in FIG. 1 at C. A concrete delivery system includes an upright hopper 24 mounted to the frame 12 in upstanding disposition above the mold 22 to provide a continuous supply of concrete or other suitable flowable paving material into mold 22. A conveyor 26 extends at an incline from the opposite side of frame 12 terminating into the upper end of hopper 24. A concrete mixing trunk (not shown) is typically used to provide a continuous supply of concrete to conveyor 26. While FIG. 1 is intended to illustrate a prior art self propelled slip-form paving machine other configurations are known and the present invention is not restricted to use with any one configuration of prior art manually operated or self propelled slip-form paving machines.

Figure 2:
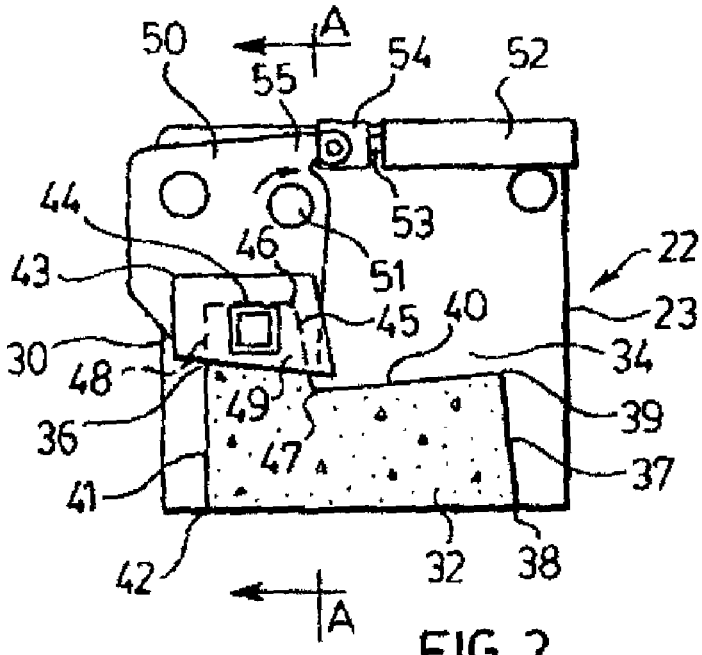
FIG. 2 is an end plan view of a prior art slip-form concrete curb and gutter mold apparatus and one embodiment of a dropped curb finisher inserted therein according to the present invention together with the concrete curb and gutter being formed.
Figure 4:
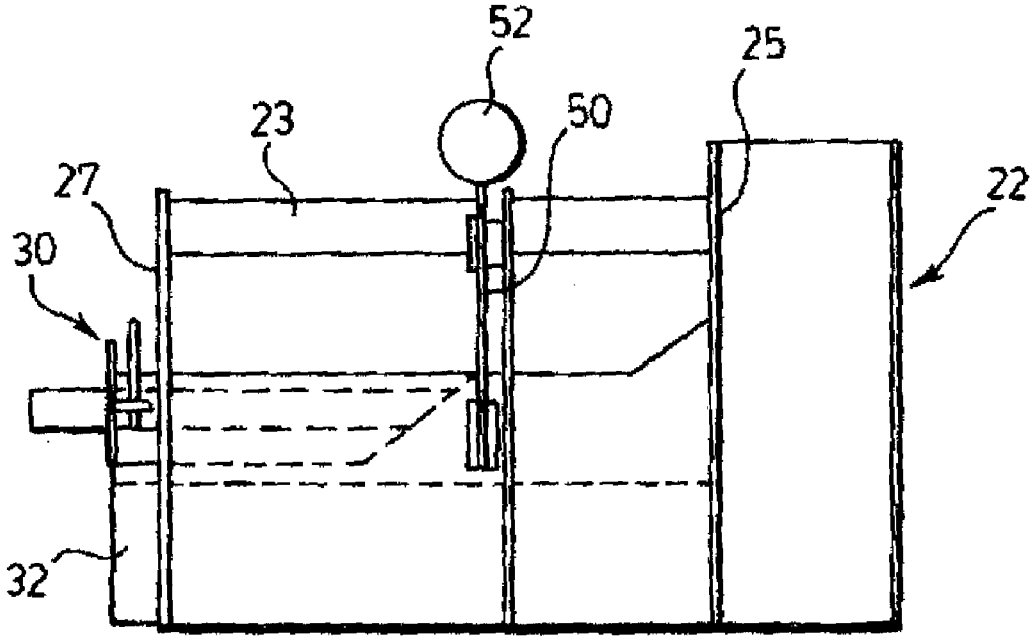
FIG. 4 is a side plan view of the slip-form concrete curb and gutter mold apparatus and one embodiment of a dropped curb finisher of FIG. 2.
Figure 3:
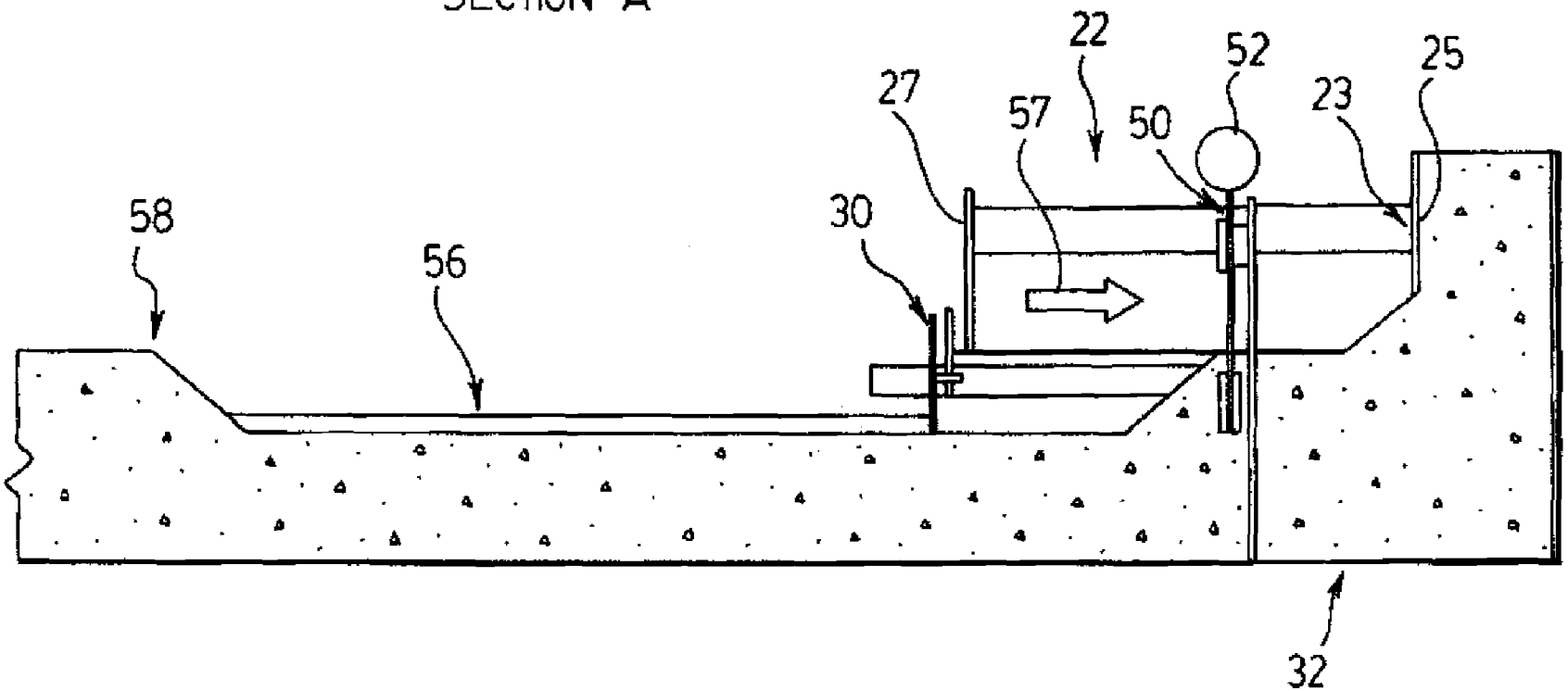
FIG. 3 is a cross-section through line "A—A" of FIG. 2.

With reference to FIGS. 2–4, FIG. 2 is an end plan view of a typical slip-form concrete curb and gutter mold 22 and one embodiment of a dropped curb finisher 30 according to the present invention together with the concrete curb and gutter, generally indicated at 32, being formed. The mold 22 consists of an external housing 23 having a cross section corresponding to the size and shape of the curb and gutter being formed. The housing 23 has a first concrete delivery end 25 in communication with the concrete delivery system noted above and through which concrete enters the mold 22. The opposite end 27 of the housing 23 is open to permit the formed concrete to exit the mold in the desired shape. The interior configuration of housing 23 of mold 22 has a gutter forming section 34 and a curb forming section 36. The gutter forming section 34 has a generally vertical front wall 37 having a bottom side 38 and a top side 39. A generally horizontal top gutter wall 40 extends inwardly from the top side 39 of front wall 37. The top gutter wall 40 slopes away from the top side 39 of front wall 37. The curb forming section 32 has generally vertical back wall 41 having a bottom side 42 and a top side 43. A generally horizontal top curb wall 44 extends inwardly from the top side 43 of back wall 37. A second curb side wall 45 depends from the end 46 of the top curb wall 44 and connects to the end 47 of the top gutter wall 40. The housing 23 of mold 22 is open to the ground (i.e. has no floor). While the configuration of the mold 22 has been defined in reference to vertical and horizontal it is understood that the size and shape of mold 22 can vary greatly from local to local depending on the specifications for curbs and gutters.

An upper portion 48 of the vertical back wall 41, curb top wall 44 and second curb side wall 45 define an opening 49 in the open end 27 of mold 22. The dropped curb finisher 30 of the present invention is inserted into opening 49 in the open end of mold 22.

A vertical plate or knife 50 is adapted to pivot around pivot point 51 by activation of a piston 52 from an open to a closed position. When the knife 50 is in the open position the flow of concrete to mold 22 is unimpeded and the concrete fills both gutter forming section 34 and a curb forming section 36 to form curb and gutter 32. When the knife 50 is in the closed position as shown in FIG. 2, the flow of concrete to the mold 22 is restricted and is blocked from the curb forming section 36 of mold 22 while still being able to fill the gutter forming section 34 of mold 22. The resulting reduction in height of the curb to form a ramp or driveway entrance is termed a dropped curb. If the dropped curb finisher 30 of the present invention was not inserted into the curb forming section 36 of mold 22, the surface of the dropped concrete left by the curb forming section 36 is a rough surface. In order to finish the surface without use of the present invention, it is necessary to form up and hand trowel the dropped concrete surface to remove excess concrete and finish the surface. In the embodiment shown knife 50 is longer than it is wide. The end 54 of rod 53 of piston 52 is attached to an upper corner 55 of knife 50. As rod 53 extends, it pivots knife 50 around pivot point 51 into the open position.

FIG. 3 shows the formation of a dropped curb 56 for a driveway or ramp in the curb and gutter 32 formed by mold 22. Arrow 57 indicates the direction of travel of the slip form paving machine. The slip form paving machine was stopped at about point 58 where the dropped curb 56 is to begin. Then knife 50 is moved to the closed position to stop the flow of concrete to the curb forming section 36 of mold 22. The slip form paving machine is moved ahead slightly to clear the curb forming section 36 of concrete. The dropped curb finisher 30 of the present invention was then inserted into mold 22 through opening 49 in the open end 27 of mold 22. As the slip form paving machine then moved forward, the knife 50 was moved to the open position. As described below, the dropped curb finisher 30 forms dropped curb 56 as the paving machine moves forward preferably with knife 50 in the open position. When the desired length of dropped curb has been formed, the paving machine is stopped and the dropped curb finisher of the present invention removed from mold 22. The only area of the curb required to be formed up and finished with a hand trowel is at the beginning of the dropped curb section at point 58 and the end of the dropped curb 56. The limited forming and hand troweling required can be efficiently and quickly done by one person.

One embodiment of a dropped curb finisher 30 of the present invention is best described with reference to FIGS. 5–7. The embodiment of the dropped curb finisher 30 illustrated has a generally vertical mounting plate 60 which is sized and shaped to cover the opening 49 in the open end 27 of mold 22. Mounting plate 60 has a bottom edge 61 front and rear surfaces 62, 63 respectively. In the embodiment illustrated as best shown in FIG. 6, the mounting plate 60 is generally in the form of a quadrilateral having opposite sides 64, 65, a bottom edge 61 and top edge 66. Bottom edge 61 is shown as inclining slightly up from the bottom of the first side 65 to the bottom of the second side 64. The angle of incline can vary depending on the form of curb and gutter to be formed.

Figure 5:
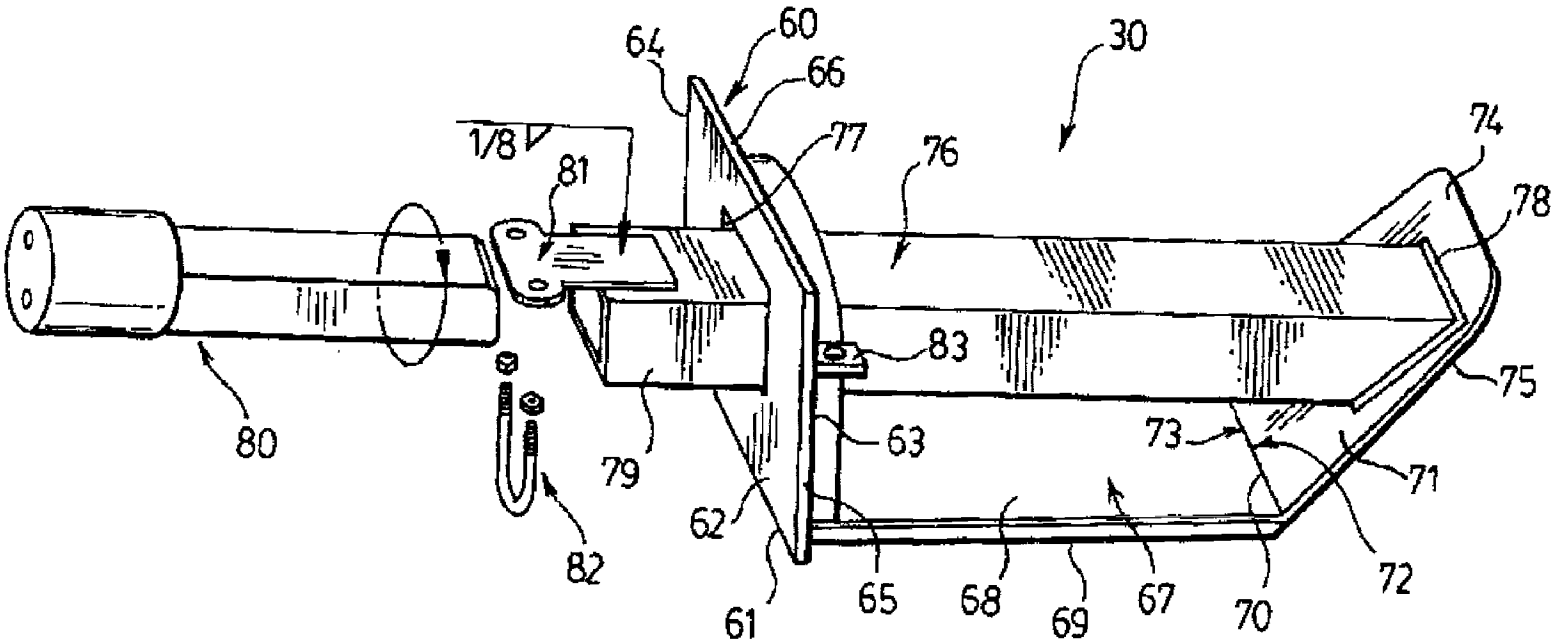
FIG. 5 is an exploded view of the components of a dropped curb finisher according to the present invention.
Figure 6:
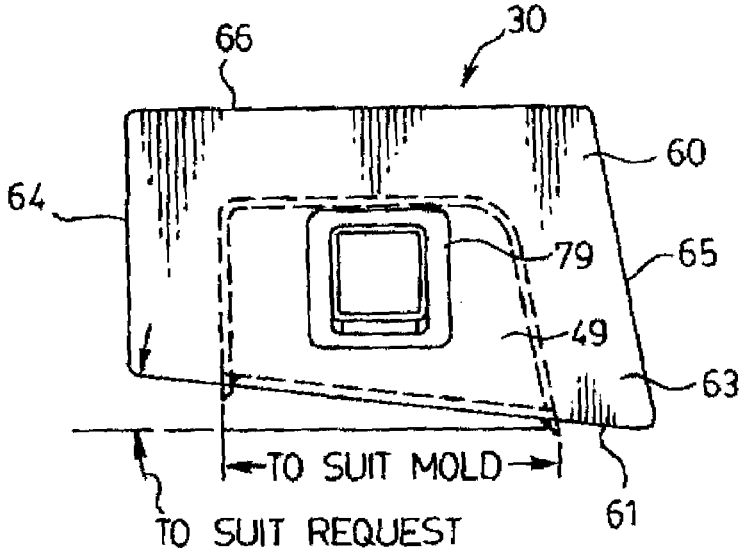
FIG. 6 is an end view of the dropped curb finisher of FIG. 5.
Figure 7:
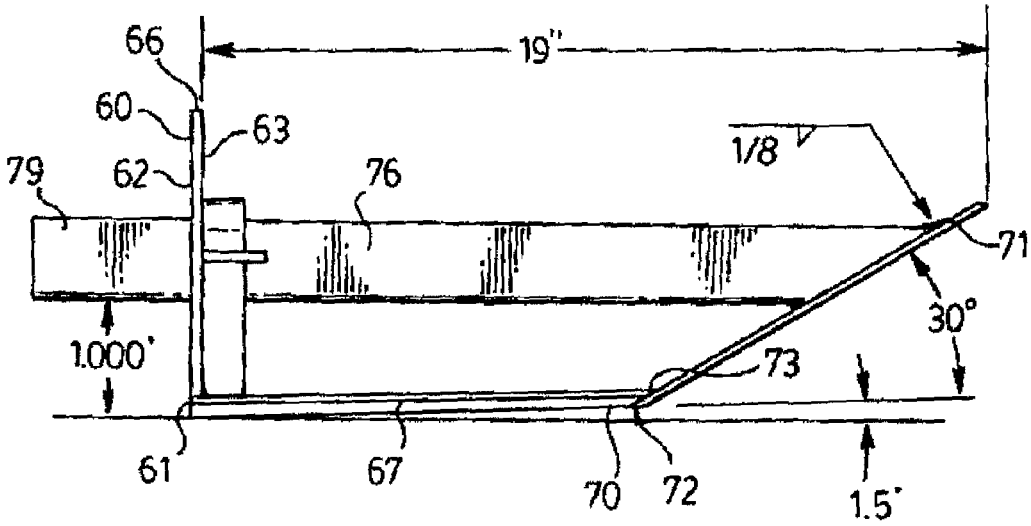
FIG. 7 is a side view of the dropped curb finisher of FIGS. 5 and 6.

As shown in FIGS. 5 and 7, a generally planar finishing plate 67 having a top surface 68 and bottom surface 69 extends rearwardly from the bottom edge 61 of the mounting plate 60. At the end 70 of the finishing plate 67 remote from the mounting plate 60, is an upwardly extending end plate 71. The bottom edge 72 of the end plate 71 is connected to the rear edge 73 of the finishing plate 67. The end plate 71 has a top surface 74 and a bottom surface 75. End plate 71 is sized and shaped to correspond to the size and shape of the opening 49 defined by the upper portion 48 of the vertical back wall 41, curb top wall 44 and second curb side wall 45 of curb forming section 36 of mold 22.

In the embodiment illustrated means for imparting vibration to the end plate 71 and finishing plate 67 includes a vibrator tube 76 extending through an opening 77 in mounting plate 60. Vibrator tube 76 has a first end 78 connected to the top surface 74 of end plate 71. The other end 79 of vibrator tube 76 that extends past mounting plate 60 is open to permit insertion of a rotating vibrator 80. The rotating vibrator 80 is held in place by any suitable method. In the embodiment shown in FIG. 5, a vibrator mounting plate 81 is attached to the vibrator tube 76 adjacent open end 79. A U-bolt 82, or other suitable fastener, is used to hold rotating vibrator 80 in place.

In the embodiment shown finishing plate 67 is inclined upwardly at an angle of about 1.5° from the horizontal from the mounting plate 60. End plate 71 is inclined at an angle of about 30° from the top surface 68 of finishing plate 67.

After the dropped curb finisher 30 is inserted into the mold 22, a pin is installed through flange 83 on mounting plate 60 and a corresponding flange (not shown) on the housing 23 of mold 22. The rotating vibrator 80 is turned on causing vibration transmitted to the end plate 71 and the finishing plate 67 to smooth the surface of the dropped curb section 57 of the curb and gutter 32 being formed.

Having illustrated and described a preferred embodiment of the invention and certain possible modifications thereto, it should be apparent to those of ordinary skill in the art that the invention permits of further modification in arrangement and detail. All such modifications are covered by the scope of the invention.

I claim:

1. A dropped curb finisher assembly for use with a slip form paving machine for forming continuous curbs and gutters, comprising:

a slip form mold having an external housing sized and shaped to a profile of a curb and gutter to be formed, the external housing having a first concrete delivery end and a second open end, the second open end having an opening defined therein, a dropped curb finisher for detachable retention in the slip form mold comprising a finishing plate the finishing plate being attached to an end plate, means for imparting vibration to the end plate and the finishing plate, the end plate being inclined upwardly from an end of the finishing plate, and the end plate and the finishing plate of the dropped curb finisher being insertable into the opening so that the end plate extends from the open end towards the concrete delivery end.

2. A dropped curb finisher assembly according to claim 1 wherein a mounting plate, is sized and shaped to cover an upper portion of an open end of the slip form mold for forming the curbs and gutters, and has a lower end attached to one end of the finishing plate remote from the end plate.

3. A dropped curb finisher assembly according to claim 1 wherein the end plate is sized and shaped to correspond to the size and shape of an opening defined by an upper portion of a vertical back wall, curb top wall and second curb side wall of a curb forming section of the slip form mold.

4. A dropped curb finisher assembly according to claim 1 wherein the finishing plate is inclined upwardly at an angle of about 1.5° from the horizontal from the mounting plate.

5. A dropped curb finisher assembly according to claim 4 wherein the end plate is inclined at an angle of about 30° from the finishing plate.

6. A method of forming a dropped curb with a slip form paving machine for forming continuous curbs and gutters, the slip form paving machine having a slip-form concrete curb and gutter mold, and a dropped curb finisher according to claim 1 is being inserted into an opening in an open end of mold when a dropped curb is to be formed, the method comprising the following steps:

(a) stopping the slip form paving machine at about a point where a dropped curb is to begin, (b) activating means for stopping a flow of concrete to a curb forming section of the slip mold, (c) moving the paving machine ahead slightly to clear the mold of concrete, (d) inserting a dropped curb finisher according to claim 1 into the mold through an opening in the open end of the mold, (e) recommencing the flow of concrete and reducing a height of the curb to create a dropped curb and activating means for imparting vibration to the dropped curb finisher as the slip form paving machine then moves forward to form the dropped curb, and (f) stopping the paving machine and removing the dropped curb finisher when a desired length of dropped curb has been formed.

7. A method according to claim 6 further including the steps of finishing a beginning of the dropped curb section and an end of the dropped curb section with a hand trowel.

8. A method according to claim 7 wherein the method of stopping the flow of concrete comprises a vertical plate adjacent the first concrete delivery end of the mold, the plate is adapted to move from an open to a closed position.

9. A dropped curb finisher for use with a slip form paving machine for forming continuous curbs and gutters, the dropped curb finisher comprising a vertical mounting plate, a finishing plate, an end plate and means for imparting vibration to the end plate and the finished plate, the mounting plate having a front surface and a rear surface and a bottom edge, the finishing plate extending rearwardly from the bottom edge of the mounting plate and said end plate inclined upwardly from an end of the finishing plate remote from the mounting plate, wherein the means for imparting vibration to the end plate and the finishing plate includes a vibrator tube extending through an opening in the mounting plate and having a first end connected to a top surface of the end plate and a second open end to permit insertion of a rotating vibrator.

* * * * *